US005298121A

United States Patent [19]

Kilmister

[11] Patent Number: 5,298,121

[45] Date of Patent: Mar. 29, 1994

[54] METHOD OF CONTROLLING THE AXIAL STRETCH PROPERTY OF A STRIP OF PAPER

[75] Inventor: George T. F. Kilmister, Dorset, England

[73] Assignee: Davy McKee (Poole) Limited, Poole

[21] Appl. No.: 838,205

[22] PCT Filed: Sep. 4, 1990

[86] PCT No.: PCT/GB90/01364

§ 371 Date: Feb. 28, 1992

§ 102(e) Date: Feb. 28, 1992

[87] PCT Pub. No.: WO91/03600

PCT Pub. Date: Mar. 21, 1991

[30] Foreign Application Priority Data

Sep. 4, 1989 [GB] United Kingdom ..... 8919936

[51] Int. Cl.[5] ..... D21F 7/06

[52] U.S. Cl. ..... 162/198; 162/253; 162/263; 162/204; 34/49; 34/68

[58] Field of Search ..... 162/DIG. 10, DIG. 11, 162/198, 262, 263, 204, 205, 254, 206, 252, 253; 34/49, 52, 54, 68; 73/621; 374/137

[56] References Cited

U.S. PATENT DOCUMENTS 3,622,448 11/1971 Adams et al. ..... 162/253
3,801,426 4/1974 Putman et al. ..... 162/DIG. 11
4,098,641 7/1978 Casey et al. ..... 162/DIG. 11
4,157,039 6/1979 Kilmister et al. ..... 374/137
4,188,731 2/1980 Rauskolb ..... 34/68
4,712,472 12/1987 Meisen et al. ..... 162/DIG. 10

FOREIGN PATENT DOCUMENTS 543853 5/1977 U.S.S.R. ..... 162/DIG. 11

OTHER PUBLICATIONS

"Computer Control of a Combination Paperboard Machine" by Dudley E. King, Jr. Tappi, Aug. 1976, vol. 59, No. 8 pp. 52–55.

*Primary Examiner*—W. Gary Jones
*Assistant Examiner*—Dean T. Nguyen
*Attorney, Agent, or Firm*—Lee, Mann, Smith, McWilliams, Sweeney & Ohlson

[57] ABSTRACT

In a paper making machine, a strip of paper is caused to pass around part of the periphery of a rotary device comprising a plurality of cylindrical bodies arranged side-by-side across the width of the strip and each body has means for producing a signal representing the tension in the portion of the strip which controls the body, the thickness of the portions is also measured. From this data, control signals are produced representing the stress per unit of cross-sectional area of the portions of the strip and the paper making machine is controlled to keep the control signals constant across the width of the strip.

2 Claims, 2 Drawing Sheets

METHOD OF CONTROLLING THE AXIAL STRETCH PROPERTY OF A STRIP OF PAPER

This invention relates to the manufacture of paper. Paper manufactured in strip form should be of uniform thickness and it is also desirable that the paper has uniform stretch characteristics. This means that, when longitudinal tension is applied to the strip of paper, it should stretch uniformly at all positions across its width.

In the use of the strip of paper subsequent to its manufacture, it is almost invariably necessary to apply longitudinal tension to the strip of paper. If the paper does not stretch uniformly across its width, the tension at some regions across the width of the strip will be greater than at other regions and the applied tension will have to be kept at a level which does not cause the paper to tear at the regions of highest tension. This is particularly true if the, or one of the, regions of highest tension is at one edge of the strip of paper. Consequently, the operating machinery which applied longitudinal tension to the strip of paper has to be operated at a speed which is less than would be the case if the stretch were uniform across its width.

Furthermore, in a multi-colour printing press, if the paper does not stretch uniformly across its width, the various colored inks applied to the paper will not be correctly positioned and the printing will be of unsatisfactory quality.

It is an object of the present invention to provide a method of controlling the axial stretch property of a strip of paper during its manufacture.

According to the present invention, in a method of operating a paper making machine to control the axial stretch property of a strip of paper manufactured in the machine, the strip of paper moving in the direction of its length and under axial tension is caused to pass around part of the periphery of a rotary device extending across the width of the paper and substantially normal to the direction of movement thereof, said device comprising a plurality of rotatable bodies arranged side-by-side and each body having means associated with it for producing a signal representing the tension in the longitudinally extending portion of the strip which contacts the body; a thickness measuring gauge is arranged to provide signals representing the effective thickness of said portions of the strip which contact the bodies; said signals are employed to produce control signals representing the load per unit of cross-sectional area of said portions of the strip; and the control signals are employed to control the operation of the paper making machine to keep said control signals substantially constant across the width of the strip.

The control signals may be used to control the moisture of the strip, or the drying rate, or the gap between various rollers of the calender in the paper making machine. The control signals may also be used to adjust the cross flow in the header or the mixing of the paper fibers in the header box as the water/paper slurry is placed on the wire mesh.

In order that the invention may be more readily understood, it will now be described, by way of example only, with reference to the accompanying drawings, in which:

BRIEF DESCRIPTION OF DRAWINGS

In FIG. 1, a conventional paper making machine is indicated generally by the reference numeral 1. The outlet of the machine is indicated by a pair of calender rollers 3. Downstream of the calender rollers, and extending transverse to the paper strip 5 leaving the paper making machine, is a rotary device 7 consisting of a plurality of cylindrical rotatable bodies 9 arranged side-by-side and rotatable about an axis 10. Each cylindrical body has means (not shown) associated with it for producing an electrical signal which represents the force applied to the periphery of the body by the part of the strip 5 which bears against it when the strip, under tension, passes over the rotary device. These signals are supplied to a control device 11. Also provided adjacent the rotary device 7 is a non-contact gauge 13 which scans the width of the strip in order to obtain signals representing the thickness of the parts of the paper which contact each of the bodies 9. The gauge 13 may also incorporate means for detecting the local moisture content and the local ash content. These detected values may be used to modify the thickness signal from the gauge 13. These modified signals representing the effective thickness of the strip are also supplied to the control circuit 11.

Figure 1:
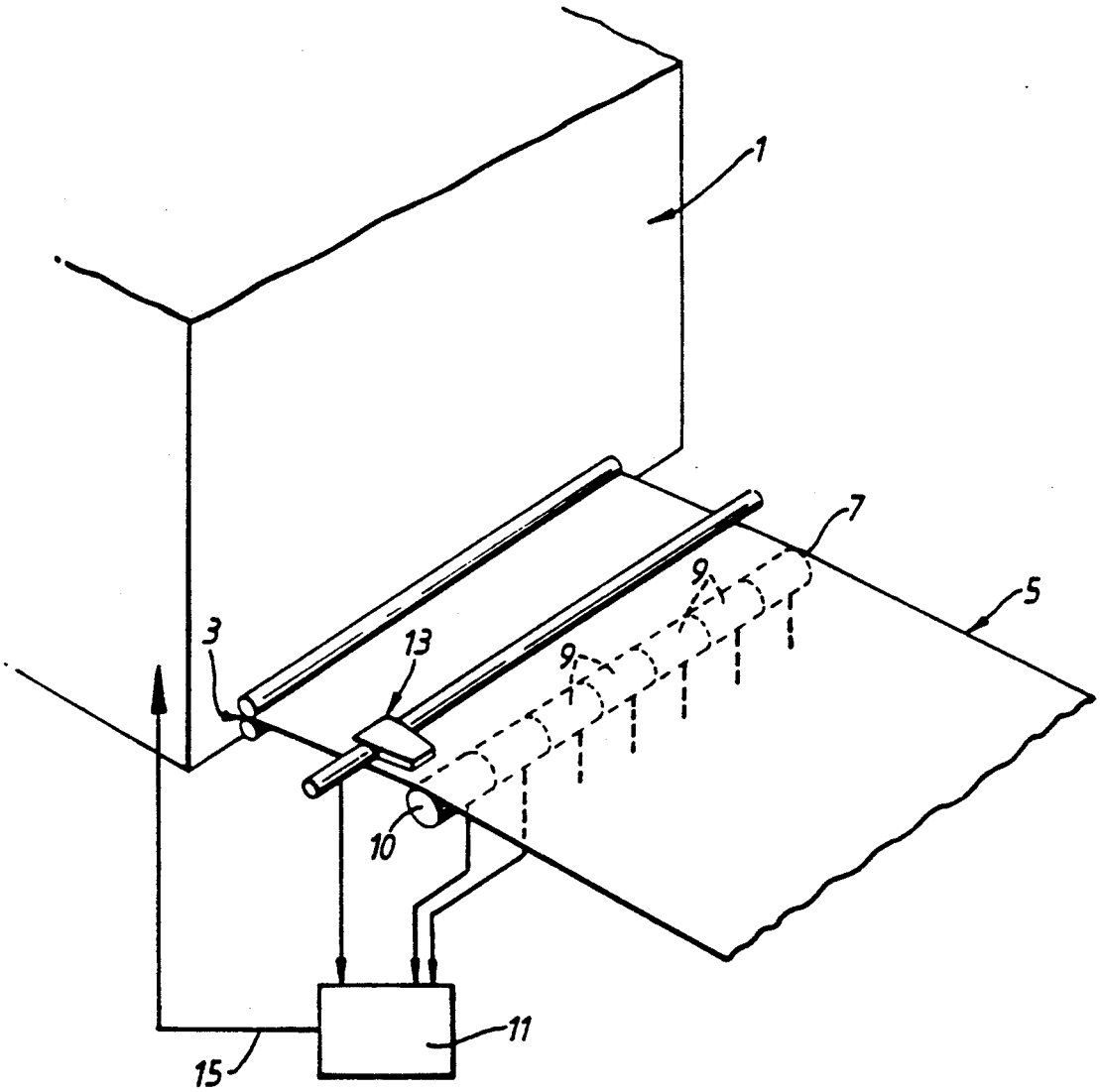
FIG. 1 shows diagrammatically a strip of paper leaving a paper making machine.

If the paper is to stretch uniformly across its width, the elastic modulus of the paper must be constant across its width.

Elastic modulus =stress/strain, therefore, stress=elastic modulus x strain.

Stress is equal to the load per unit area in the paper and the rotary device provides signals representing the average tension in the part of the paper which passes over each of its bodies. The thickness gauge indicates the effective thickness profile of the part of the strip of paper which passes over each of the bodies and so, consequently, knowing the width of each roller, the cross-sectional area of the paper passing over each body can be determined. From a consideration of the cross-section area of the paper and the applied tension in the strip, the load per unit area of paper can be determined and, consequently, the mean stretch in the paper on each of the bodies can be determined.

Provided that the paper is stretched elastically over the full width of the rotary measuring device 7, a uniform stretch characteristic in the paper will give a uniform corrected stress indication across the rotary device. In the control device 11, the load per unit area of the paper is determined for each of the bodies and signals are fed back on the line 15 to the paper making machine 1 in order to correct for any variations in stress determined by the rollers. In the machine 1, this correction can be brought about by adjusting the moisture content of the paper upstream of the device 7 at regions across the width of the strip of paper corresponding to the portions of the strip which contact the bodies 9. Alternatively, the rate at which the paper is being dried, or the gap between the rollers of the one or more of the calenders can be adjusted. If, having equalized the load per unit area, there are variations in axial stretch property in the finished paper, then the elastic modulus is varying across the paper. This is normally due to the non-random distribution of the paper fibers and can be adjusted by modifying the crossflow or mixing in the header box of the machine.

Figure 2:
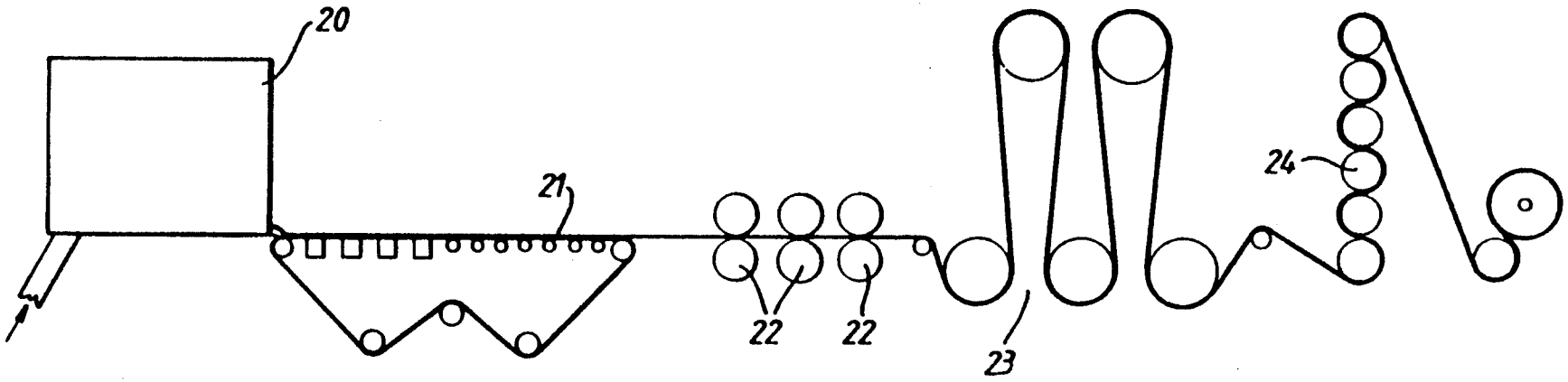
FIG. 2 shows diagrammatically a paper making machine.

FIG. 2 shows diagrammatically a paper making machine in which pulp is introduced into a header box 20 and a slurry is then laid on a wire mesh 21. The slurry is then pressed between rollers 22, dried in a dryer 23 and rolled in a calender stack 24 before being reeled.

In FIG. 1, the rotary device is shown downstream of the calender stack, but it may be preferred to place it upstream of the stack 24.

The dryer 23 comprises a multiplicity of rollers around which the strip is wrapped. Most, if not all, of the rollers are heated and, in one practical application of the invention, one of the rollers consists of a plurality of drums arranged side-by-side across the width of the strip. Each of the drums is steam-heated and the heat applied to each drum is variable independently of the other drums. When the signals fed back t the machine from the control circuit indicate that one or more zones across the width of the strip are subjected to variations in stress, changes can be made to the heat applied to the corresponding drum or drums to compensate, at least in part, for the variations in stress.

In a preferred arrangement, the dryer 23 includes a bank of infra-red heaters arranged side-by-side across the path taken by the strip. The heaters are controlled independently and, by employing one or more heaters corresponding to each body 9 of the shapemeter, a rapid and accurate adjustment can be made to the drying of the zones across the width of the paper strip.

As an alternative to adjusting the drying of the paper in the paper making machine, a group of sprays may be located across the path taken by the strip after it leaves the dryer 23. Zones of the paper strip which are shown to be "tight" can be loosened by spraying the zone with a liquid, conveniently water, and then re-drying the strip. The operation of the sprays is controlled by signals supplied by the control circuit on line 15.

It is well known for one or more of the rolls in the calender stack to be a controllable deflection roll, known as a NIPCO roll. With such a roll, the pressure applied by the roll at regions along its length can be adjusted. Consequently, the pressure applied to the paper strip by the NIPCO roll, at regions across its width corresponding to regions of incorrect stress per unit of cross-sectional area, can readily be adjusted in the sense to adjust the stress into conformity with that of other parts of the strip.

If it is shown that the elastic modulus is varying across the paper, this is most likely due to the fact that the fibers of the pulp are not distributed randomly in all directions. The header box 20 distributing the slurry on to the mesh can be angled to give a turbulence which maximizes the distribution of the fibers but, by adjusting the position of the header box, the pattern of the fiber distribution can be changed.

I claim:

1. A method of operating a paper making machine comprising a header box from which a pulp slurry is laid on a conveyor, rollers for squeezing the pulp slurry into a strip, means for adjusting the moisture content of the strip and rolls for compressing the strip, in order to control the axial stretch property of a strip of paper manufactured in the machine, and having a given width and traveling in a direction of movement, said method comprising the steps of:

applying longitudinal tension to the strip of paper exiting in the direction of its length from the machine;

causing the strip of paper under longitudinal tension to pass around part of the periphery of a rotary device extending across the width of the paper and substantially normal to the direction of movement thereof, said device comprising a plurality of rotatable bodies arranged side-by-side and each body having means associated with it for producing a signal representing tension in a longitudinally extending portion of the strip which contact the body;

sending said tension signals to control means;

for each of the longitudinally extending portions of the strip which contact the bodies, producing a signal representing the effective thickness thereof;

sending said thickness signals to said control means wherein the load per unit cross-sectional area of each portion is derived from said tension and thickness signals, and a control signal representing said load per unit cross-sectional area for each portion is produced; and sending said control signals to control the operation of the moisture adjusting means for the compressing rolls at regions across the width of the strip corresponding to the longitudinally extending portions of the strip which contact the rotatable bodies in order to keep the control signals uniform across the width of the strip to achieve uniform axial stretch properties of the strip.

2. A method as claimed in claim 1 in which drying means are positioned at regions across the width of the strip of paper corresponding to the portions of the strip which contact the body and the operation of the moisture adjusting means comprises adjusting the output of said drying means.

* * * * *